US007107881B1

(12) United States Patent
Liou

(10) Patent No.: US 7,107,881 B1
(45) Date of Patent: Sep. 19, 2006

(54) SPRING CLAMP

(76) Inventor: Ferng-Jong Liou, No. 48-1, Cheng Fong Lane, Taiming Rd., Wu Jih, Taichung (TW)

( * ) Notice: Subject to any disclaimer, the term of this patent is extended or adjusted under 35 U.S.C. 154(b) by 0 days.

(21) Appl. No.: 11/135,395

(22) Filed: May 24, 2005

(51) Int. Cl.
*B25B 7/14* (2006.01)
*B25B 5/00* (2006.01)

(52) U.S. Cl. ..... 81/318; 81/320

(58) Field of Classification Search ..... 81/318–320, 81/323, 324, 415
See application file for complete search history.

(56) References Cited

U.S. PATENT DOCUMENTS 1,944,116 A * 1/1934 Stratman ..... 81/300
2,539,865 A * 1/1951 Sarvie ..... 81/323
2,620,697 A * 12/1952 Sarvie ..... 81/320
2,798,491 A * 7/1957 Samuels ..... 606/188
3,313,190 A * 4/1967 Bothum ..... 81/323
6,212,977 B1 4/2001 Liou ..... 81/323
6,860,179 B1 * 3/2005 Hopper et al. ..... 81/318
2004/0000221 A1 * 1/2004 Kesinger et al. ..... 81/367

* cited by examiner

*Primary Examiner*—David B. Thomas
(74) *Attorney, Agent, or Firm*—Troxell Law Office, PLLC

(57) ABSTRACT

A spring clamp includes a first and a second handle; a substantially L-shaped release link having an inner section transversely mounted in the first handle and an outer section located outside the first handle, and being pivotally turnably about a supporting point mounted in the first handle between the inner and the outer section of the release link; and a shaft having a front end fixedly connected to a movable jaw extended from a distal end of the second handle and a rear end obliquely extended through a hole on the inner section of the release link. To release the two handles of the spring clamp from an immovable position when clamping two workpieces together, a user needs only to downward push the outward projected outer section of the release link using one finger.

3 Claims, 3 Drawing Sheets

SPRING CLAMP

FIELD OF THE INVENTION

The present invention relates to a spring clamp, and more particularly to a spring clamp that can be conveniently operated to release two handles of the spring clamp from an immovable position when clamping two workpieces together simply by downward pushing a lever outward projected from an outer side of one handle of the spring clamp.

BACKGROUND OF THE INVENTION

A spring clamp is mainly used to tightly clamp two workpieces together for subsequent machining of the workpieces. For instance, when two pieces of wood boards are firmly clamped between two jaws of the spring clamp, it is more conveniently to perform drilling or cutting on the workpieces.

U.S. Pat. No. 6,212,977 B1 granted to the same inventor of the present invention discloses a spring clamp having an auxiliary locating mechanism mounted in one handle of the spring clamp. The auxiliary locating mechanism is adapted to temporarily immovably hold the two handles of the spring clamp in place when they have been moved toward each other to tightly clamp two workpieces together, and to release the two handles from the immovable position when the machining of the workpieces has been completed. To release the two handles via the auxiliary locating mechanism, a user has to extend one finger into a space between the two handles to depress a push plate located thereat. It is somewhat troublesome and inconvenient to do so. Moreover, the spring clamp disclosed in the above-mentioned U.S. Pat. No. 6,212,977 B1 has pretty complicate parts and components that require more time and labor to assemble and prevent the spring clamp from being manufactured at reduced cost.

It is therefore desirable to develop an improved spring clamp to eliminate the above-mentioned drawbacks.

SUMMARY OF THE INVENTION

A primary object of the present invention is to provide a spring clamp that can be conveniently operated with one finger to release two handles of the spring clamp from an immovable position when clamping two workpieces together.

Another object of the present invention is to provide a spring clamp that has simplified parts and components and can therefore be easily assembled at reduced manufacturing cost.

To achieve the above and other objects, the spring clamp according to the present invention includes an upper and a second handle; a release link having an inner section transversely mounted in the first handle and an outer section located outside the first handle, and being pivotally turnably about a supporting point mounted in the first handle between the inner and the outer section of the release link; and a shaft having a front end fixedly connected to a movable jaw extended from a distal end of the second handle and a rear end obliquely extended through a hole on the inner section of the release link.

When the two handles are moved toward each other for the spring clamp to tightly clamp two workpieces together, an outer peripheral surface of the shaft is tightly abutted against two diametrically opposite inner walls of the through hole on the inner section of the release link, causing the two handles of the spring clamp to be immovably held in place. And, when the outer section of the release link is downward pushed with one finger, the release link is pivotally turned to separate the inner walls of the through hole on the inner section from the shaft, allowing the two handles to spring outward under a spring force of the spring clamp.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
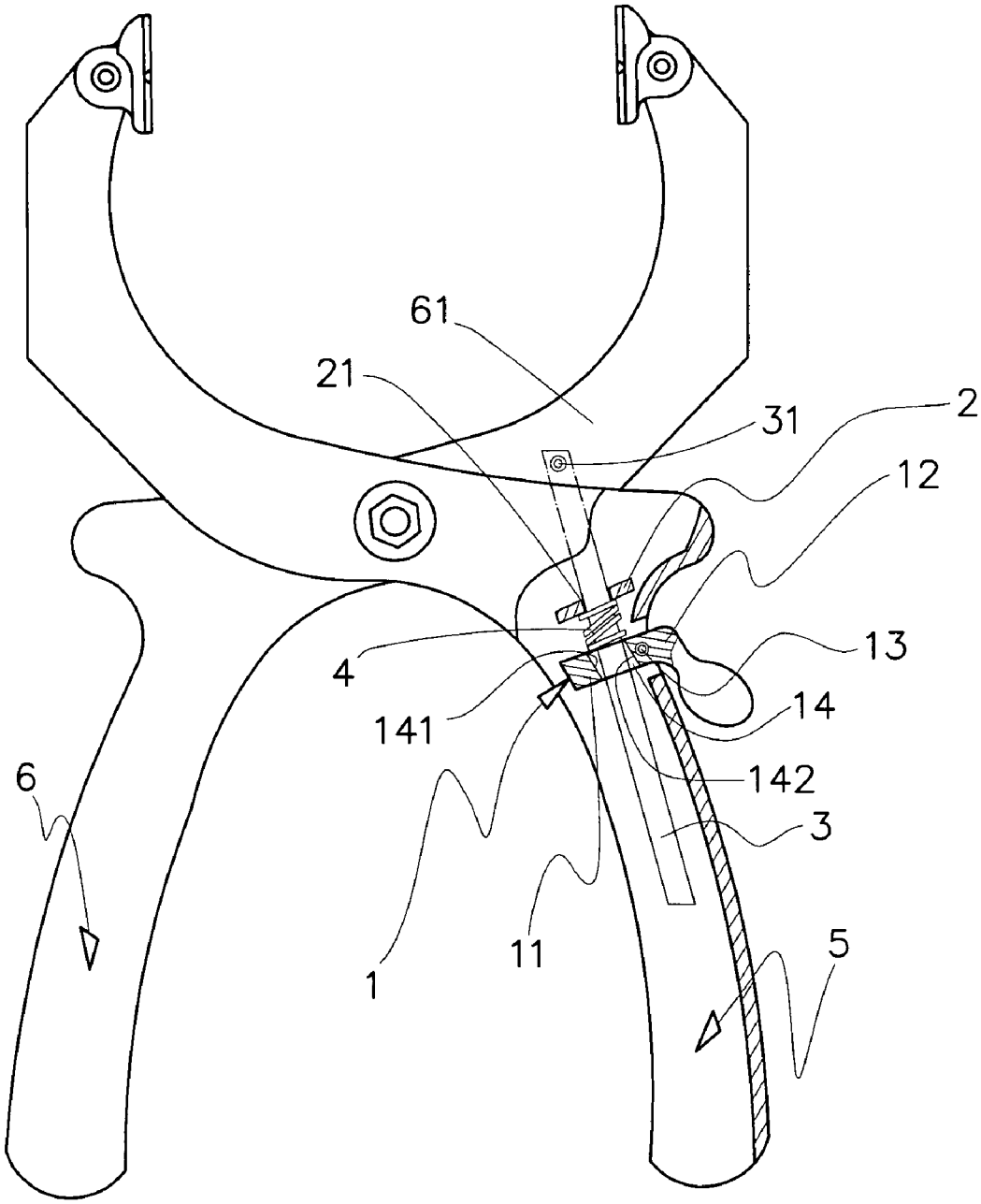
FIG. 1 is a partially sectioned plan view of a spring clamp according to the present invention.

Please refer to FIG. 1 that is a partially sectioned plan view of a spring clamp according to the present invention. As shown, the spring clamp includes a first handle 5 having a release link 1 mounted thereon, and a second handle 6 being pivotally connected to the first handle 5 and having a movable jaw 61 integrally extended from a distal end thereof.

The release link 1 is a substantially L-shaped member having an inner section 11 transversely mounted in the first handle 5 and an outer section 12 located outside the first handle 5. A supporting point 13 is provided in the first handle 5 between the inner and the outer section 11, 12 of the release link 1, so that the release link 1 is pivotally turnable about the supporting point 13 when the outer section 12 is downward pushed. The outer section 12 of the release link 1 may be in the form of a lever, and is projected from a point on an outer side of the first handle 5 near a neck portion thereof. The inner section 11 of the release link 1 is provided with a vertically extended through hole 14, via which a shaft 3 is obliquely extended. The shaft 3 has a front end fixedly connected to the movable jaw 61 of the second handle 6 using an inserted pin 31, and a rear end downward extended through the hole 14. A stopper 2 is fixedly mounted in the first handle 5 above the inner section 11 of the release link 1 by a predetermined distance. The stopper 2 is provided with a vertical through hole 21, via which the shaft 3 is extended before being extended through the hole 14 on the release link 1. A compression spring 4 is put around the shaft 3 between the inner section 11 of the release link 1 and the stopper 2.

Figure 2:
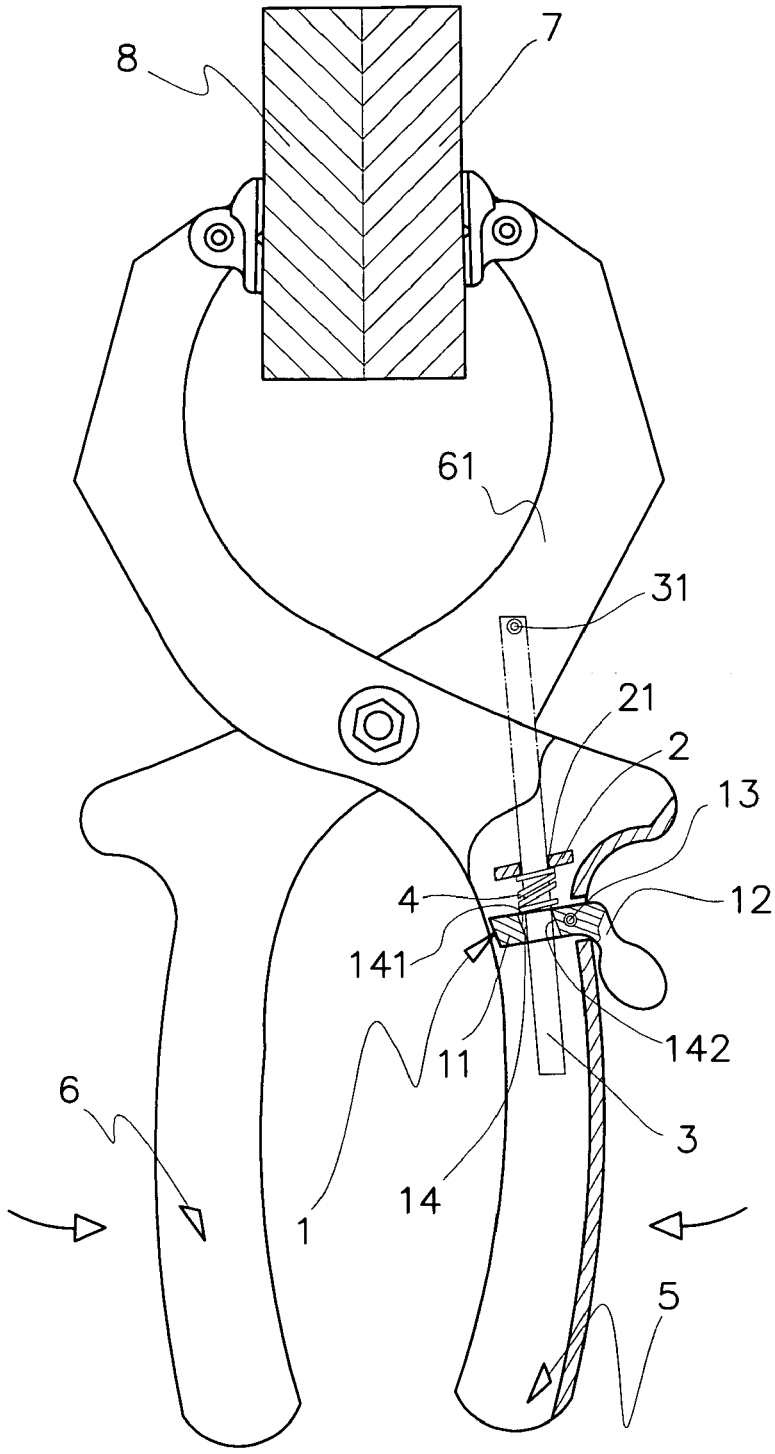
FIG. 2 is a plan view showing two handles of the spring clamp of FIG. 1 are moved toward each other and immovably held in place for the spring clamp to tightly clamp two workpieces together.

Please refer to FIG. 2 that is a partially sectioned plan view showing the first and the second handle 5, 6 of the spring clamp of the present invention are moved toward each other for the spring clamp to tightly clamp two workpieces 7, 8 together. At this point, the inner section 11 of the release link 1 is in an inclined position relative to the shaft 3, such that two diametrically opposite inner wall surfaces 141, 142 of the through hole 14 are tightly abutted against two diametrically opposite sides of an outer peripheral surface of the shaft 3, causing the first and the second handle 5, 6 to be immovably held in place.

Figure 3:
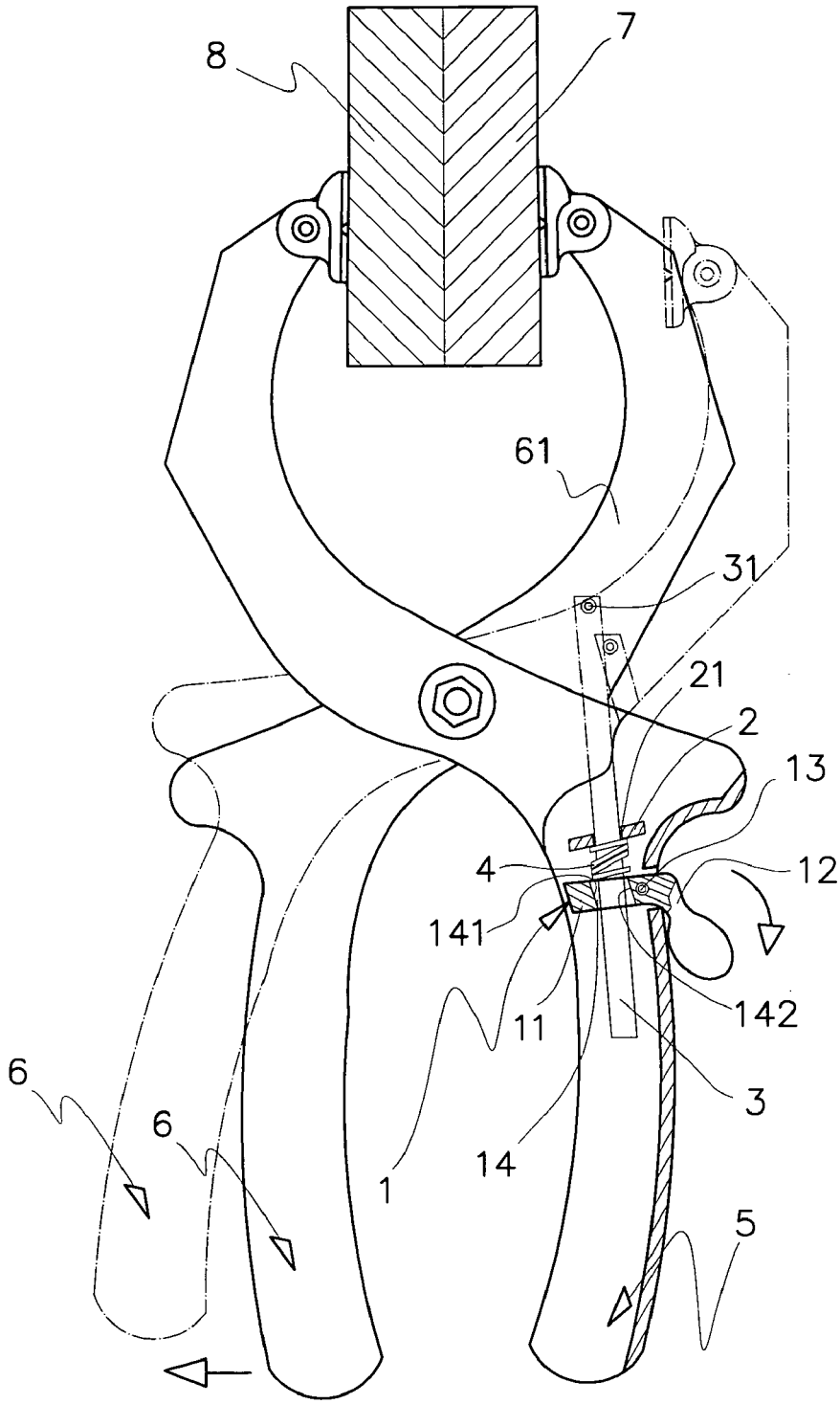
FIG. 3 is a plan view showing the manner of releasing the two handles of the spring clamp of the present invention from the immovable position by way of downward pushing a lever outward projected from one handle.

Please refer to FIG. 3. When it is desired to release the two handles 5, 6 from the immovable position to release the clamped workpieces 7, 8, simply downward push the outer section 12 of the release link 1 with one finger, and the inner section 11 of the release link 1 is synchronously pivotally turned about the supporting point 13 to an upper position to press against the compression spring 4, causing the two diametrically opposite inner wall surfaces 141, 142 of the through hole 14 to separate from the outer peripheral surface of the shaft 3. At this point, the second handle 6 of the spring clamp is sprung outward to an initial position due to an elastic force of spring clamp.

What is claimed is:

1. A spring clamp, comprising:

a first handle and a second handle pivotally connected to said first handle at a predetermined point;

a release link substantially in the form of an L-shaped member having an inner section transversely mounted in said first handle and an outer section located outside said first handle; a supporting point being provided in said first handle between said inner and said outer section of said release link, so that said release link is pivotally turnable about said supporting point when said outer section is downward pushed;

a stopper fixedly mounted in said first handle above said inner section of said release link by a predetermined distance, and provided with a vertically extended hole;

a compression spring mounted between said inner section of said release link and said stopper; and a shaft having a front end fixedly connected to a movable jaw extended from a distal end of said second handle, and a rear end extended through said stopper, said compression spring, and said inner section of said release link.

2. The spring clamp as claimed in claim 1, wherein said outer section of said release link is projected from a point on an outer side of said first handle near a neck portion thereof.

3. The spring clamp as claimed in claim 1, wherein said inner section of said release link is provided with a vertically extended through hole, via which said shaft is obliquely extended.

* * * * *